US007566105B2

(12) United States Patent
Janda et al.

(10) Patent No.: US 7,566,105 B2
(45) Date of Patent: Jul. 28, 2009

(54) MOVABLE DIVIDER FOR A REFRIGERATED DRAWER

(75) Inventors: Timothy M. Janda, Stevensville, MI (US); Michele Wilcox, Stevensville, MI (US); Andrew M. Tenbarge, St. Joseph, MI (US); Karen J. Querfurth, Coloma, MI (US); Paul B. Allard, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 288 days.

(21) Appl. No.: 10/908,324

(22) Filed: May 6, 2005

(65) Prior Publication Data

US 2006/0250062 A1 Nov. 9, 2006

(51) Int. Cl.
*A47B 88/00* (2006.01)

(52) U.S. Cl. ..... 312/402; 312/330.1; 312/348.3

(58) Field of Classification Search ..... 312/402, 312/404, 348.3, 348.5, 291, 348.1, 330.1; 62/377, 382; 220/529, 531, 536, 559, 541, 220/545, 548

See application file for complete search history.

(56) References Cited

U.S. PATENT DOCUMENTS

| | | | | | |
|---|---|---|---|---|---|
| 258,020 | A * | 5/1882 | Cochrane | 312/31.2 |
| 1,445,464 | A * | 2/1923 | West et al. | 62/382 |
| 1,570,009 | A * | 1/1926 | Sanders, Jr. | 62/382 |
| 1,754,911 | A * | 4/1930 | Sherwood et al. | 312/308 |
| 1,799,831 | A * | 4/1931 | Pauls | 220/541 |
| 2,281,398 | A * | 4/1942 | Walley | 62/382 |
| 2,303,275 | A * | 11/1942 | Hull | 220/548 |
| 2,498,402 | A * | 2/1950 | Earle | 312/351 |
| 2,840,083 | A * | 6/1958 | Myers | 220/558 |
| 3,109,432 | A * | 11/1963 | Regenhardt | 220/548 |
| 5,242,223 | A * | 9/1993 | Koves | 312/348.3 |
| 5,269,600 | A * | 12/1993 | Arreola et al. | 312/348.3 |
| 5,584,412 | A * | 12/1996 | Wang | 220/500 |
| 5,992,959 | A * | 11/1999 | Kawamoto | 312/348.3 |
| 6,014,867 | A * | 1/2000 | Floysvik | 62/255 |
| 6,880,903 | B2 * | 4/2005 | O'Halloran et al. | 312/407 |
| 2003/0136271 | A1 | 7/2003 | Kim | |
| 2003/0137227 | A1 * | 7/2003 | Hoenig | 312/348.3 |

FOREIGN PATENT DOCUMENTS

| | | | |
|---|---|---|---|
| JP | 2004324940 | A | 11/2004 |
| WO | 2004/104504 | A1 | 12/2004 |

* cited by examiner

*Primary Examiner*—James O Hansen
(74) *Attorney, Agent, or Firm*—Kirk Goodwin; Michael D. Lafrenz

(57) ABSTRACT

A rigid divider in a refrigerated drawer is pivotably mounted between the side walls of the drawer and is movable between a first vertical position and a second horizontal position. In the second position, the divider acts as a shelf to support food items.

18 Claims, 3 Drawing Sheets

MOVABLE DIVIDER FOR A REFRIGERATED DRAWER

FIELD OF THE INVENTION

The invention relates to refrigerated drawers and more particularly to a movable divider in a refrigerated drawer.

DESCRIPTION OF THE RELATED ART

It is common to employ drawers to store refrigerated food items. Refrigerated drawers can be found in residential and commercial applications and frequently appear as stand alone or built in refrigerated units. In a residential application, for example, a refrigerated drawer may be disposed in a cabinet beneath a kitchen counter for convenient access. Drawers are also commonly used in conjunction with a larger refrigerated compartment. For example, drawers are frequently used inside conventional refrigerators for separately storing items such as meat, produce, and fruits. As well, one or more freezer compartments in a refrigerator may actually be a slidable drawer. The term "refrigerated drawer" thus includes any drawer adapted by design or position to hold food items at less than ambient temperature.

Dividers are sometimes provided within refrigerated drawers to separate food items within the drawer. But heretofore there has been limited flexibility in arranging space within a refrigerated drawer compartment. There is a need for more flexibility in dividing space within a refrigerated drawer.

SUMMARY OF THE INVENTION

According to one embodiment of the invention, a divider is mounted to the sidewalls in a refrigerated drawer for movement between a first position where the divider is substantially parallel to the back wall and a second position where the divider is substantially parallel to the bottom wall. Preferably, the divider is pivotably mounted to the side walls for rotational movement about a pivot axis.

DETAILED DESCRIPTION

Figure 1:
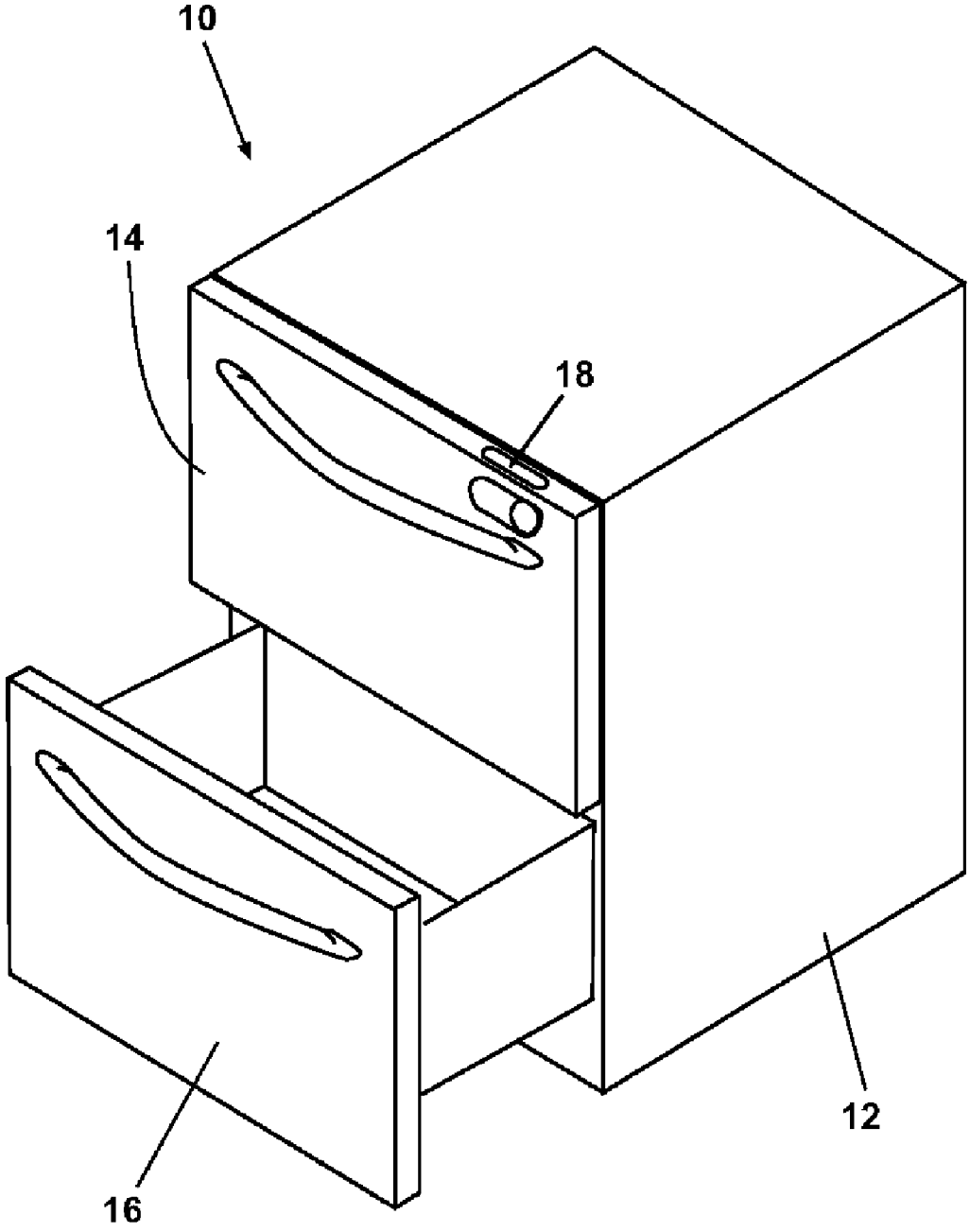
FIG. 1 is a perspective view of a refrigerator containing two refrigerated drawers of the type that can incorporate a divider according to one embodiment of the invention.

One example of a refrigerator associated with the invention is shown in FIG. 1. The refrigerator 10 comprises a cabinet 12 with two slidable refrigerated drawers 14, 16. It will be understood that the cabinet 12 can be a stand alone unit or a built in under-counter unit. Controls 18 for the refrigeration can be provided on or in the cabinet 12, or, as shown, on one or more of the refrigerated drawers 14, 16. How the drawers are refrigerated is not pertinent to the invention.

Figure 2:
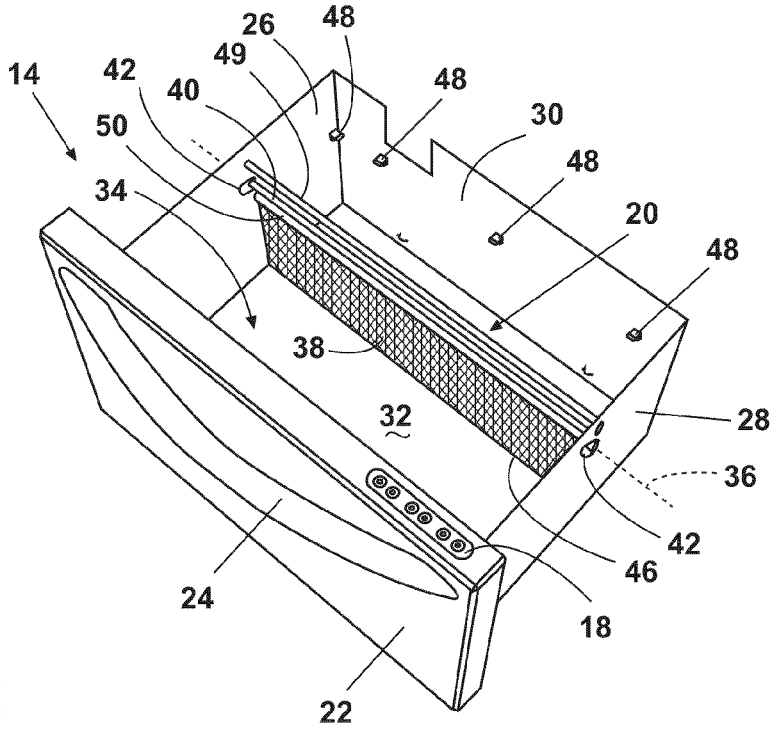
FIG. 2 is an enlarged perspective view of a refrigerated drawer of FIG. 1 with a divider in the vertical position.
Figure 3:
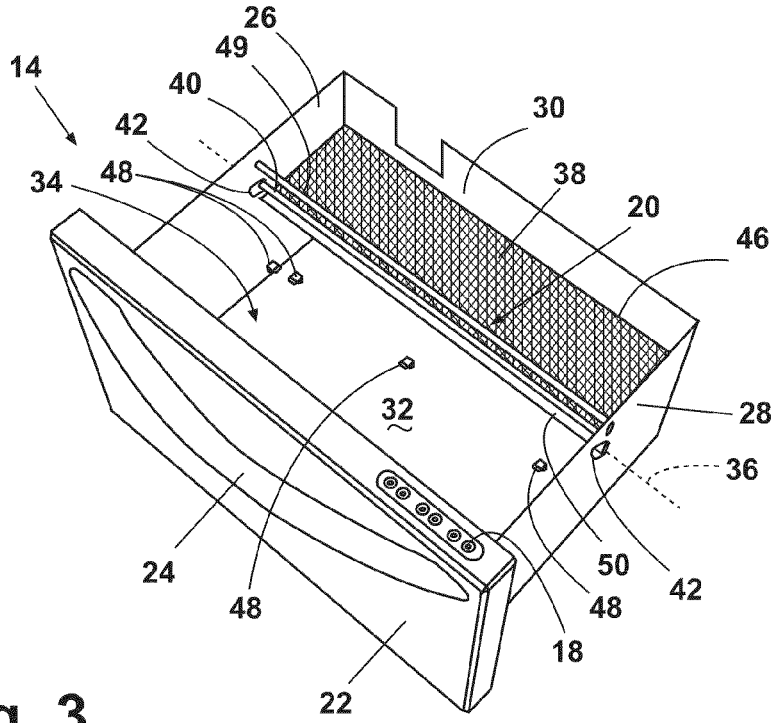
FIG. 3 is an enlarged perspective view of the refrigerated drawer of FIG. 2 with the divider in the horizontal position.

Looking now at FIGS. 2 and 3, the refrigerated drawer 14 comprises a divider 20 according to one embodiment of the invention. The refrigerated drawer 14 has a front wall 22 on which a handle 24 is provided to facilitate access to the drawer. Sidewalls 26, 28, back wall 30, and bottom wall 32 combine with the front wall 22 to define a compartment 34.

The divider 20 is mounted to the sidewalls 26, 28 for movement between a first position as shown in FIG. 2 where the divider is substantially parallel to the back wall 30, and a second position as shown in FIG. 3 wherein the divider is substantially parallel to the bottom wall 32.

In this embodiment, the divider 20 is pivotably mounted to the sidewalls 26, 28 by any of a variety of ways known in the art, for rotational movement about a pivot axis 36. The divider 20 comprises a panel 38 mounted to a rod 40 that it is mounted to and extends between the sidewalls 26, 28. Preferably, the rod 40 is not removable from the sidewalls 26, 28 without using a tool such as a screwdriver, for example. It may be that the panel 38 is pivotable about the rod 40, or it may be that the rod 40 is rigidly secured to the panel 38 and pivots in holes 42 in the respective sidewalls 26, 28. Either way, the rod 40 effectively defines the pivot axis 36 about which a free edge 46 of the panel 38 can move.

The panel 38 is preferably formed of a rigid material of sufficient strength to support food items. Such materials include, for example, metals, carbon fibers, composites, or hard plastics. Further, it is preferred that the panel 38 be sufficiently porous to permit air flow therethrough. Thus, for example, the panel 38 can be a metal screen or mesh disposed in a rigid frame, or it can be a planar, perforated panel. Additionally, the panel 38 need not but preferably does extend from one side wall 26 to the other 28 as shown.

At least one of the walls has a retainer to retain the divider 20 in a predetermined position at or between the first and second positions. Here, the back wall 30 has several projections 48 extending into the compartment 34 that function to retain the divider 20 in the second position. When the divider 20 is in the second position as shown in FIG. 3, the free edge 46 rests on the projections 48 so that the panel 38 effectively forms a shelf on which food items can rest. In order to facilitate movement of the free edge 46 past the projections 48, the holes 42 in the sidewalls 26, 28 are preferably elongated so that the rod 40 can slide away from the back wall 30. It will be understood that other types of retainers are within the scope of the invention such as the detents, pins, assorted fasteners, fabric connectors such as hook and loop fasteners, snap fit connections, and the like. As well, a retainer, such as one or more projections 48, can be provided in the bottom wall 32 to facilitate retaining the divider 20 in the first position. In like manner, one or more retainers can be provided in a side wall 26, 28 to retain the divider 20 in a position intermediate the first and second positions as well as in the first and second positions. As illustrated herein. projections 48 are shown on the side wall 26 to retain the divider in the first or second position. Similar projections may be on side wall 28. but are not visible in the figures.

In the embodiment illustrated in FIG. 2 and 3, the location of the rod 40 on the sidewalls 26, 28 with respect to the bottom wall 32 and the back wall 30 will depend upon the desired width of the panel 38 between the rod 40 and the free edge 46. Preferably, the holes 42 will be spaced from the bottom wall 32 a distance equal to the width of the panel 38. Likewise, the holes 42 will be spaced from the back wall 30 a distance equal to or slightly greater than the width of the panel 38.

It can also be seen in FIGS. 2 and 3 that a second rod 49 can be disposed between the sidewalls 26, 28 and spaced above the rod 40. It will be apparent that when the divider 20 is in the second position (as a shelf), the second rod 49 will help to keep taller items from falling off of the divider when the refrigerated drawer slidably moves.

Figure 4:
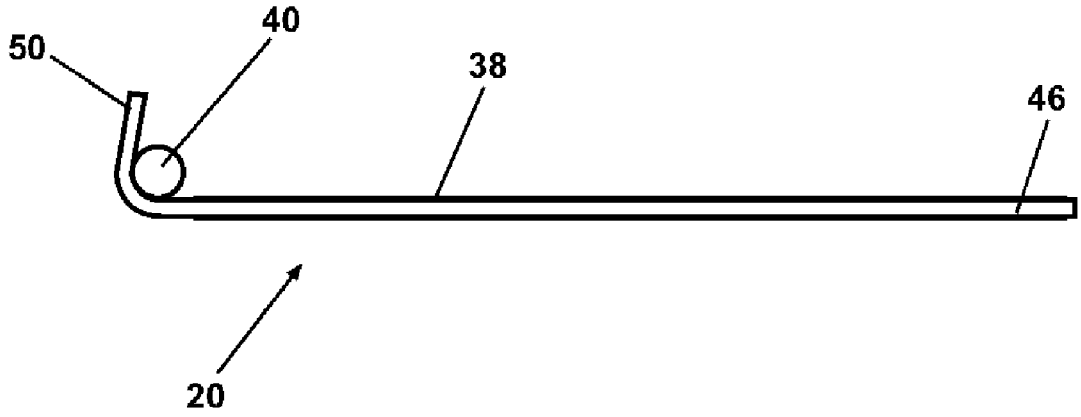
FIG. 4 is a side view of the divider of FIGS. 2 and 3.

Looking now at FIG. 4, a side view of an exemplary divider 20 shows a lip 50 adjacent the rod 40 and extending generally normally from the panel 38. It will be apparent that when the divider 20 is in the second position (as a shelf), the lip 50 will help to keep items from falling off of the divider when the refrigerated drawer slidably moves.

It can be seen that a refrigerated drawer according to the invention may provide increased flexibility in arranging space within the compartment. Depending on placement of the divider 20 it can, at a user's option, serve a traditional function of dividing the compartment 34 into smaller spaces. As well, the divider 20 in the second position can provide a shelf on which to place items for more convenient access.

While the invention has been specifically described in connection with certain specific embodiments thereof, it is to be understood that this is by way of illustration and not of limitation, and the scope of the appended claims should be construed as broadly as the prior art will permit. Thus, for example, the divider 20 is not limited to pivotable movement; it can be slidably movable between a first and second positions. As well, multiple panels 38 can be provided on a single rod 40 or on separate rods. Other embodiments of the invention may be readily ascertained by the described "preferred" embodiments. For example, while it is preferred that the panel 38 be sufficiently porous to permit air flow therethrough, in other embodiments it need not be.

What is claimed is:

1. A refrigerator comprising:

a cabinet defining an interior; and a drawer slidably mounted to the cabinet for movement between an open position and a closed position, and comprising:

a back wall, bottom wall and first and second opposing sidewalls defining a compartment having an open top;

a divider pivotably mounted to the first and second opposing sidewalls for rotational movement about a pivot axis between a first position where the divider is substantially parallel to the back wall and defines a portion of the compartment in front of the divider and a portion of the compartment behind the divider that are directly accessible through the open top when the drawer is in the open position, and a second position where the divider is substantially parallel to and spaced from the bottom wall to define a shelf, with a portion of the compartment above the divider and a portion of the compartment below the divider are directly accessible through the open top when the drawer is in the open position; and a retainer on the back wall, to retain an edge of the divider in the second position.

2. The refrigerator of claim 1 wherein the divider is porous.

3. The refrigerator of claim 2 wherein the divider is not removable from the drawer without the use of a tool.

4. The refrigerator of claim 3 wherein one edge of the divider has a lip.

5. The refrigerator of claim 4 wherein the divider extends between the first and second opposing sidewalls.

6. The refrigerator of claim 1 wherein at least one of the bottom wall, the first sidewall, and the second side wall has a retainer to retain an edge of the divider in the first position.

7. The refrigerator of claim 1 wherein the divider is not removable from the drawer without the use of a tool.

8. The refrigerator of claim 1 wherein one edge of the divider has a lip.

9. The refrigerator of claim 8 wherein the drawer further comprises a front wall, and the edge of the divider having the lip is spaced from the front wall in the second position.

10. The refrigerator of claim 1 wherein the divider is removable from the drawer with the use of a tool.

11. The refrigerator of claim 1 wherein the divider extends between the first and second opposing sidewalls.

12. The refrigerator of claim 11 wherein the drawer further comprises a front wall and one edge of the divider is spaced from the front wall in the second position.

13. The refrigerator of claim 1 wherein the divider comprises a rod mounted to and extending between the sidewalls, and a panel mounted to the rod, the rod defining the pivot axis.

14. The refrigerator of claim 13 wherein the panel comprises two parallel edges, and the rod is closer to one of the edges than the other.

15. The refrigerator of claim 1 wherein the drawer further comprises a front wall and one edge of the divider is spaced from the front wall in the second position.

16. The refrigerator of claim 1 wherein the divider further comprises two parallel edges, and the pivot axis of the divider is closer to one of the edges than the other.

17. A refrigerator comprising:

a cabinet defining an interior; and a drawer slidably mounted to the cabinet for movement between an open position and a closed position, and comprising:

a back wall, bottom wall and first and second opposing sidewalls defining a compartment having an open top, which is closed by the cabinet when the drawer is in the closed position;

a divider pivotably mounted to the first and second opposing sidewalls for rotational movement about a pivot axis between a first position where the divider is substantially parallel to the back wall and defines a portion of the compartment in front of the divider and a portion of the compartment behind the divider that are directly accessible through the open top when the drawer is in the open position, and a second position where the divider is substantially parallel to and spaced from the bottom wall to define a shelf, with a portion of the compartment above the divider and a portion of the compartment below the divider are directly accessible through the open top when the drawer is in the open position;

a first retainer on the bottom wall, to retain an edge of the divider in the first position; and a second retainer on at least one of the back wall, the first sidewall and the second sidewall to retain an edge of the divider in the second position.

18. The refrigerator of claim 17 wherein the divider is porous.

* * * * *